US005209376A

United States Patent [19]

Dirksing

[11] Patent Number: 5,209,376

[45] Date of Patent: May 11, 1993

[54] CO-DISPENSING PUMP FOR FLUENT MATERIALS

[75] Inventor: Robert S. Dirksing, Cincinnati, Ohio

[73] Assignee: The Procter & Gamble Company, Cincinnati, Ohio

[21] Appl. No.: 850,757

[22] Filed: Mar. 13, 1992

[51] Int. Cl.[5] ..... B67D 5/00

[52] U.S. Cl. ..... 222/80; 222/137; 222/162; 222/321; 222/391

[58] Field of Search ..... 222/80, 87, 135-137, 222/145, 162, 321, 340, 391; 239/303

[56] References Cited

U.S. PATENT DOCUMENTS

| | | | |
|---|---|---|---|
| 975,646 | 11/1910 | Sidney . | |
| 2,705,463 | 4/1955 | Moore | 107/1 |
| 2,750,900 | 6/1956 | Moore | 107/52 |
| 2,873,887 | 2/1959 | Spero | 222/94 |
| 2,939,610 | 6/1960 | Castelli et al. | 222/94 |
| 2,944,704 | 7/1960 | Taylor | 222/94 |
| 3,007,611 | 11/1961 | Coolidge | 222/137 |
| 3,135,428 | 6/1964 | Gallo, Sr. | 222/94 |
| 3,200,995 | 8/1965 | Gangwisch | 222/94 |
| 3,217,931 | 11/1965 | Farrar et al. | 222/94 |
| 3,289,887 | 12/1966 | Farrar et al. | 222/1 |
| 3,813,012 | 5/1974 | Laird | 222/326 |
| 3,910,466 | 10/1975 | Collar | 222/327 |
| 4,215,802 | 8/1980 | Ornsteen | 222/146.5 X |
| 4,260,077 | 4/1981 | Schroeder . | |
| 4,340,154 | 7/1982 | VanManen | 222/94 |
| 4,366,919 | 1/1983 | Anderson | 222/137 |
| 4,426,022 | 1/1984 | Lang et al. | 222/130 |
| 4,437,584 | 3/1984 | Connors et al. | 222/137 |
| 4,438,871 | 3/1984 | Eckert | 222/137 |
| 4,471,888 | 9/1984 | Herb et al. | 222/137 |
| 4,493,436 | 1/1985 | Brokaw | 222/80 |
| 4,560,610 | 1/1986 | Herb | 222/137 |
| 4,588,920 | 9/1986 | Drake | 366/177 |
| 4,589,572 | 5/1986 | Pomarolli | 222/83.5 |
| 4,690,306 | 9/1987 | Staheli | 222/80 |

FOREIGN PATENT DOCUMENTS

| | | | |
|---|---|---|---|
| 2521392A1 | 11/1976 | Fed. Rep. of Germany . | |
| 082686 | 3/1982 | United Kingdom | 222/137 |

*Primary Examiner*—Gregory L. Huson

*Attorney, Agent, or Firm*—E. Kelly Linman; Michael E. Hilton; Thomas H. O'Flaherty

[57] ABSTRACT

A finger actuated dispenser for a multi-component reactant toothpaste, or other fluent materials. The dispenser preferably comprises at least two coaxial cylindrical product reservoirs wherein the uppermost end of each product reservoir communicates with the other reservoirs through generally coaxial nozzles. The lowermost end of each reservoir is equipped with a concentric piston connected rearward of its leading face to the rearward portions of the other pistons by a plurality of radially oriented spokes having knife edges on their forwardmost surfaces. The knife edges taper outwardly at an acute angle relative to the longitudinal axis of the reservoirs from the interior of the innermost reservoir toward the outermost reservoir, thereby outwardly expanding the innermost surface of the innermost reservoir wall as the pistons and knife edges are advanced upwardly relative to the product reservoirs. This increases the circumferential tension in the innermost reservoir wall and causes slitting or rupturing thereof at the points where the knife edges engage the innermost reservoir wall.

17 Claims, 6 Drawing Sheets

CO-DISPENSING PUMP FOR FLUENT MATERIALS

TECHNICAL FIELD

The present invention has relation to a compartmental package for storing and simultaneously dispensing at least two viscous fluids.

The present invention has further relation to a compartmental package for simultaneously dispensing at least two viscous fluids at a predetermined ratio and which provides for substantially simultaneous runout of said viscous fluids.

In a particularly preferred embodiment, the present invention has relation to an inexpensively manufactured, hand held co-dispensing package for two reactant materials, e.g. a toothpaste and a bleaching agent, which package is provided with a finger actuated push button to facilitate dispensing.

BACKGROUND ART

It is sometimes desirable to simultaneously dispense two viscous paste or liquid materials which are reactant when in contact with one another. It is further desirable that such products be dispensed at a specific ratio for optimum performance. Pump type dispensers for two component products such as an epoxy and a hardener or a cosmetic and an activator are generally known. For example, U.S. Pat. No. 4,438,871 issued to Eckert on Mar. 27, 1984, discloses a push button style dispenser wherein two coaxial metering pistons are operated simultaneously and charges of product are simultaneously delivered from two individual pump chambers in quantities dependent upon the cross-section of the respective pistons. The intake of each of the individual pump chambers is ported into its own supply reservoir. Unfortunately, valve losses in smaller pumps tend to be greater than in larger pumps. It is therefore anticipated that the dispensed ratio of the two components in packages of this type will tend to vary. Consequently, one of the two product reservoirs is likely to be exhausted before the other.

One means to provide a specific product dispensing ratio and substantially simultaneous runout from a two component co-dispensing package is to displace the two components directly from their respective reservoirs with pistons which are caused to move simultaneously and equally. One such co-dispensing package for dispensing two materials in equal quantities is disclosed in U.S. Pat. No. 4,260,077 to Schroeder in April 1981. The dispenser of Schroeder consist of two joined parallel barrels and two joined plungers with attached pistons, one for each barrel. The distal ends of the plungers are joined to one another so that as the plunger assembly is advanced into the barrels, simultaneous and equal displacement of the pistons attached to the proximal ends of the plungers is assured. The result is substantially simultaneous dispensing of the two product components and also substantially simultaneous runout of the same. Unfortunately, co-dispensing packages of this sort are at least twice the length of the product chamber because of the need to externally join the plungers to one another. Further, since there is no mechanical advantage inherent in actuators of the type normally utilized on this type of dispenser, such dispensers are best suited to dispensing small quantities of product of relatively low viscosity with each stroke of the actuator.

U.S. Pat. No. 4,690,306 issued to Staheli on Sep. 1, 1987 discloses a dispensing device consisting of at least two chambers containing pasty substances, the pistons in the chambers being connected to one another by at least one blade oriented perpendicular to the product chambers and adapted for cutting through a dividing wall which separates the chambers from one another. One disclosed package embodiment employs a cartridge having two product components to be dispensed from coaxially arranged cylindrical chambers. The cylindrical chambers are partly closed at their forward end by a front wall. The central chamber is equipped with a circular piston and the outer chamber is equipped with an annular piston at their rearward ends. The pistons employed in the disclosed embodiment of Staheli are connected to one another by means of four radial blades having their sharp forward edges oriented perpendicular to the package's cylindrical axis and arrayed at angles of 90° relative to each other. The blades allow the concentric pistons to advance in unison in their respective chambers by cutting through the internal wall between the outermost and central product chambers at the points where the blades contact the wall.

Because the blades of Staheli are arranged at right angles to the internal wall that is to be cut as the pistons advance, the blades must be sharp and comprised of a material which will cleanly cut the internal wall material without causing wrinkling or buckling of the internal wall.

Unfortunately, the foregoing functional compatibility requirement between the blades and the internal wall material of the package of Staheli is further complicated by the need for compatibility between the product components housed within the package and the wall material employed in the package structure, e.g., barrier properties, resistance to premature rupture, etc. All of the foregoing factors contribute toward increased cost and decreased reliability in the resulting package.

OBJECTS OF THE INVENTION

Accordingly, it is an object of the present invention to provide a highly reliable manually actuated dispenser for a multi-component product, wherein at least two components are simultaneously dispensed at a predetermined, but not necessarily equal, ratio and wherein both components are exhausted substantially simultaneously.

It is another object of the present invention to provide such a dispenser which can be inexpensively manufactured to make disposal thereof economically viable, if the end user so desires, once the contents have been completely dispensed.

DISCLOSURE OF THE INVENTION

In a particularly preferred embodiment, the present invention comprises a finger actuated dispenser for a multi-component reactant toothpaste. The dispenser preferably comprises at least two coaxial cylindrical product reservoirs wherein the uppermost end of each product reservoir communicates with the other reservoirs through generally coaxial nozzles. The discharge orifices of each of the nozzles preferably reside in a substantially common plane. The lowermost end of each reservoir is equipped with a concentric piston connected rearward of its leading face to the rearward portions of at lease one other piston by radially arrayed spokes each have a slitting knife edge on its forwardmost surface. The slitting knife edges taper at an acute angle relative to the length of the reservoirs from the interior of the innermost reservoir toward the outermost reservoir, thereby engaging, outwardly expanding and rupturing the innermost reservoir wall as the pistons and knife edges are advanced upwardly relative to the product reservoirs. In a particularly preferred embodiment, the knife and piston assembly is mechanically advanced by a spring clip which engages a stationary rod. A finger operated push button located at the uppermost end of the package is used to move the concentric reservoirs downwardly while the spring clip prevents the pistons from moving. The knife edges slit the wall of the innermost reservoir as the product components are dispensed during this portion of the cycle. The spring clip permits the pistons to move upwardly along with the concentric reservoirs as they return to their at rest position. This process is repeated until the pistons have traversed the entire length of the reservoirs.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE INVENTION

Figure 1:
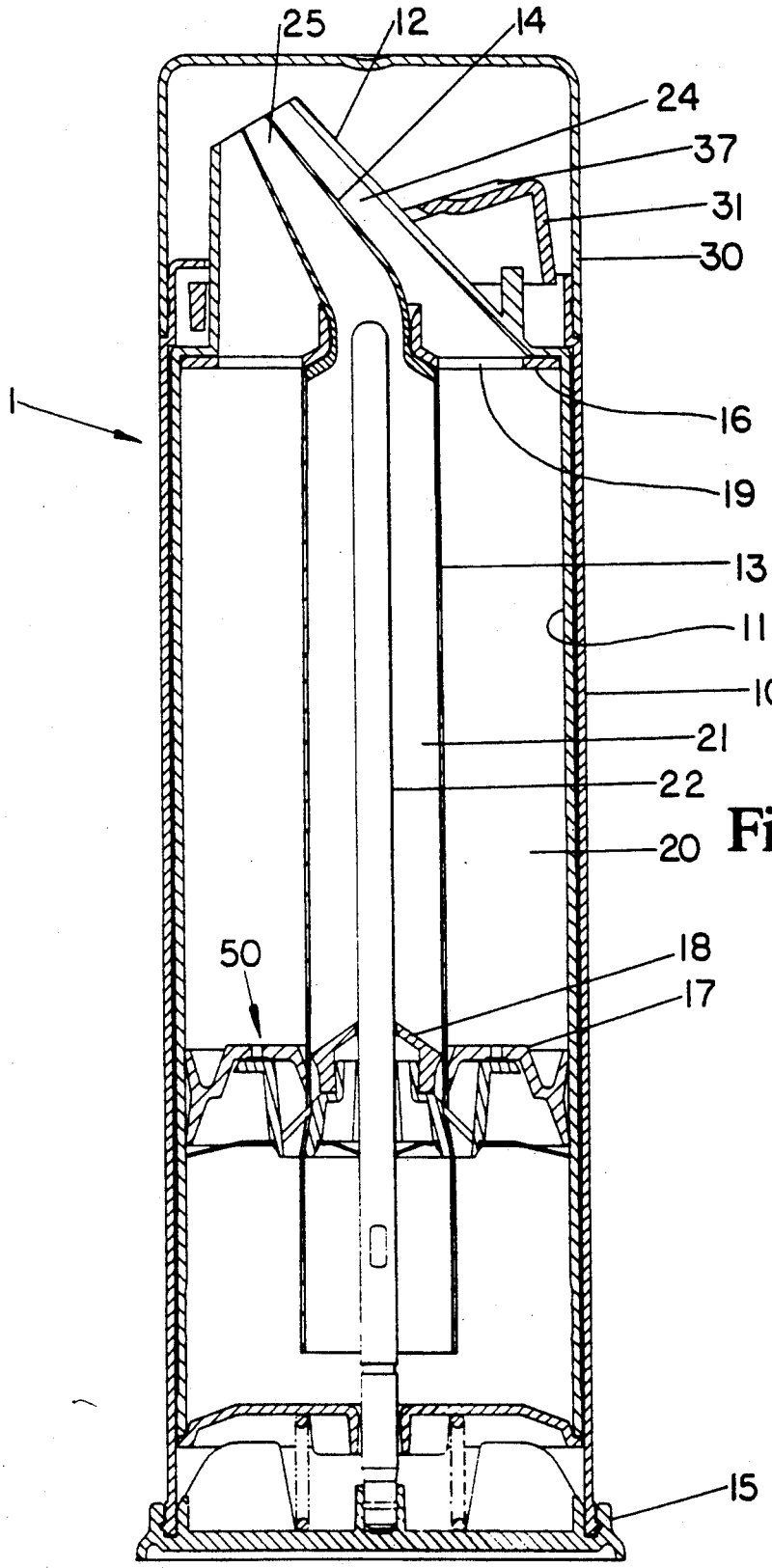
FIG. 1 is a cross-sectional view of a particularly preferred dispenser of the present invention.

FIG. 1 shows a cross-sectional view of a preferred two-component dispenser 1 of the present invention. Dispenser 1 comprises a shell 10, a major component container 11, and a minor component container 13. Major component nozzle 12 is attached to the uppermost end of major component container 11 and minor component nozzle 14 is attache to the uppermost end of minor component container 13. Base 14 is attached to and covers the lowermost end of shell 10. Support 16 is attached to the uppermost end of the interior of major component container 11 and supports minor component container 13 in a generally coaxial alignment with major component container 11. Support 16 also positions minor component nozzle 14 in generally coaxial alignment with major component nozzle 12. Because the orifices of both nozzles are located substantially in a common plane, the major an minor components remain substantially isolated from one another until such time as they exit the dispenser 1. The interior of minor component container 13 above minor piston 18 and about rod 22 generally defines minor component reservoir 21. The interior of major component container 11 above major piston 7 and about the exterior of minor component container 13 generally defines major component reservoir 20.

Openings 19 in support 16 and the channel between the interior of major component nozzle 12 and the exterior of minor component nozzle 14 together define the major component flow path 24. The channel within the interior of minor component nozzle 14 defines the minor flow path 25.

Removable overcap 30 preferably snaps onto a reduced diameter at the uppermost portion of shell 10 for storage and transport of the dispenser 1 either from the manufacturer to the end user or between successive uses of the dispenser by the end user.

Figure 3:
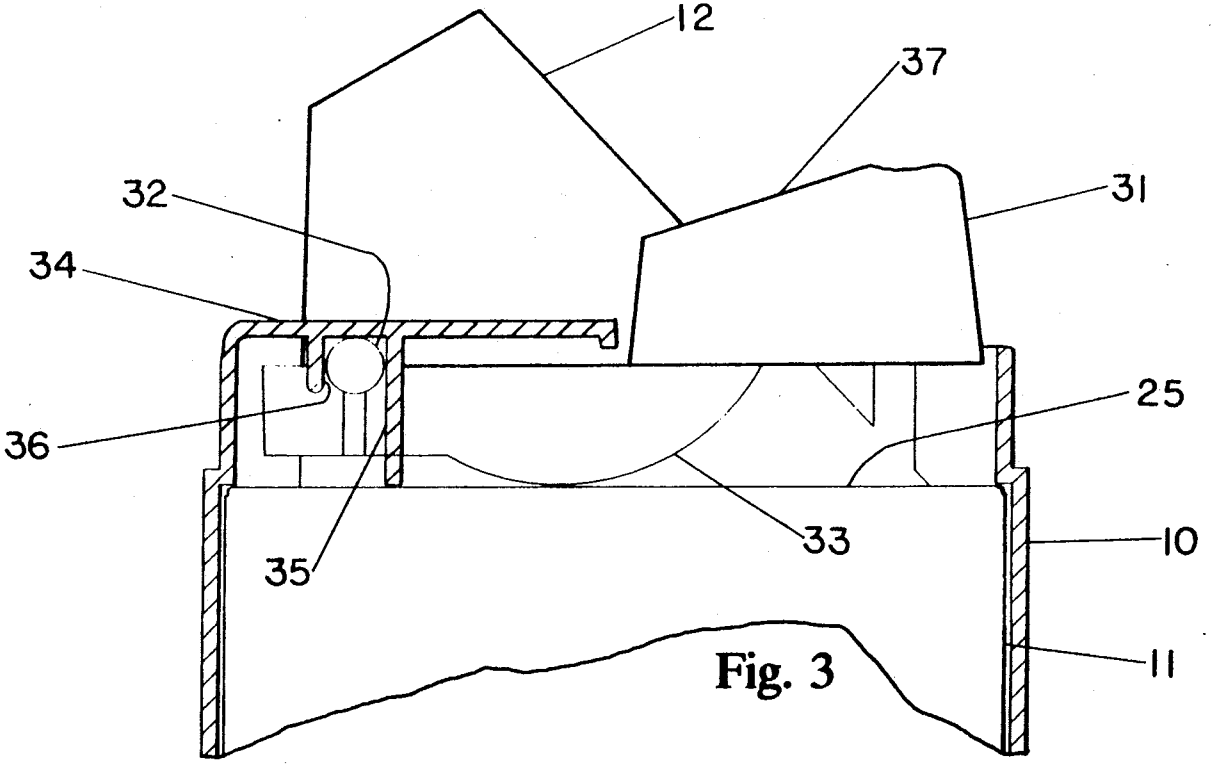
FIG. 3 is an enlarged, partially sectioned, simplified view of the push button area of the dispenser of FIGS. 1 and 2 with the push button in its normal at rest condition.

Actuator 31 comprises push button 37, cam 33, and pivot 32. Pivot 32 nests between partitions 35 and 36, which project downwardly from upper wall 34 of shell 10. Cam 33 of actuator 31 rests against the upper wall 25 of major component container 11. In FIG. 3, actuator 31 is shown in its normal at rest condition with push button 37 projecting through an opening in the uppermost end of shell 10.

Figure 4:
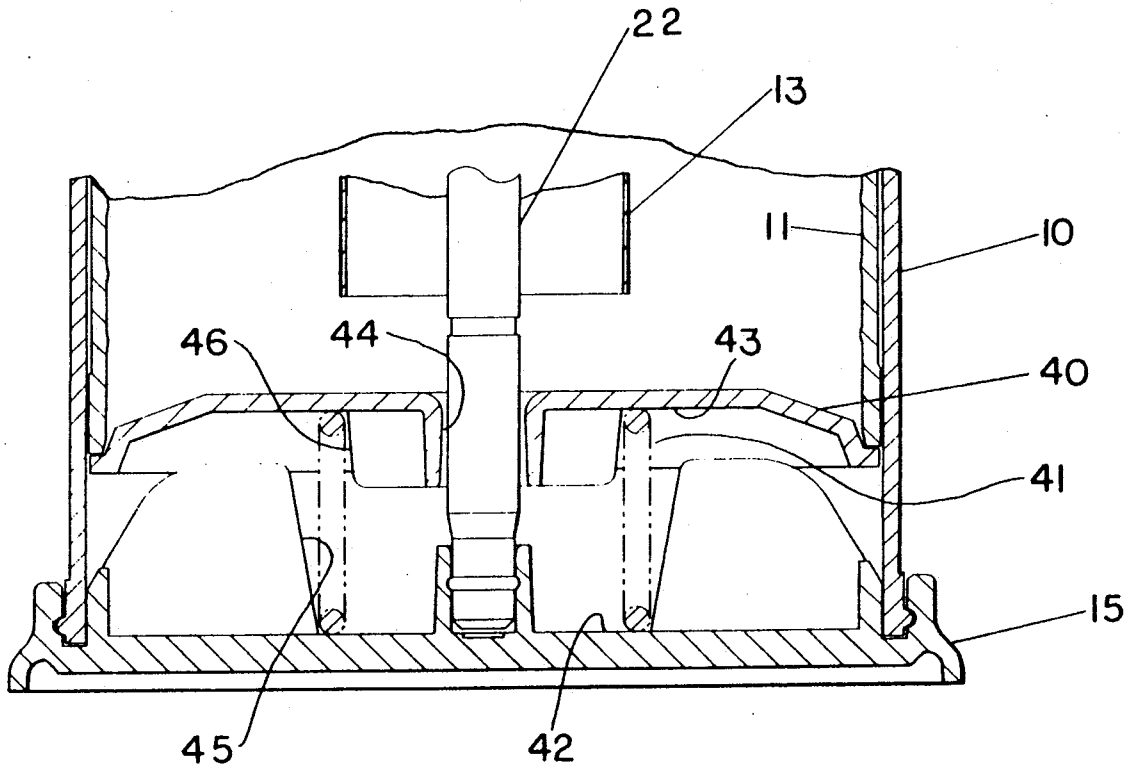
FIG. 4 is an enlarged, partially sectioned, simplified view of the lowermost portion of the dispenser of FIGS. 1 and 2.

FIG. 4 is an enlarged, partially sectioned, simplified view of the lowermost portion of the dispenser 1 of FIG. 1. Shell 10 is fastened to base 15 by means of a complementary ring and groove arrangement. Washer 40 fits within the lowermost open end of major component container 11. Spring 41 is sandwiched between the innermost surface 42 of base 15 and the lowermost surface 43 of washer 40. Spring 41 is preloaded in compression so as to force washer 40 away from base 15. Washer 40 translates this spring force to the lowermost end of major component container 11. Opening 44 in washer 40 provides clearance for rod 22, which is also secured to base 15 by means of a complementary ring and groove arrangement. Gussets 45 and 46 help to stiffen base 15 and washer 40 respectively and maintain the axially aligned position of spring 41.

Figure 5:
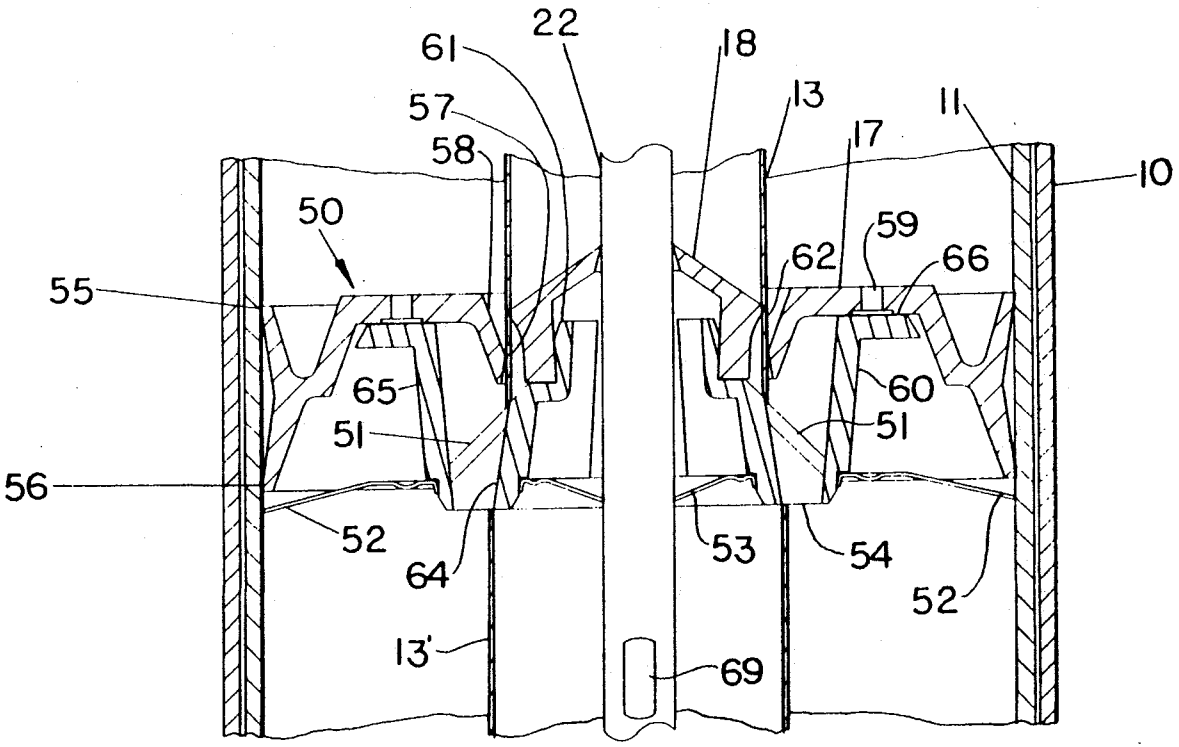
FIG. 5 is an enlarged, partially sectioned, simplified view of the piston assembly portion of the dispenser of FIGS. 1 and 2.

FIG. 5 is an enlarged partially sectioned, simplified view of the dispenser 1 in the vicinity of the piston and knife assembly 50 after insertion. The piston and knife assembly 50 comprises major component piston 17, minor component piston 18, knife support 60, major component spring clip 52, and minor component spring clip 53. Major component piston 17 fits within major component container 11 with wipers 55 and 56 providing an outer seal with the innermost surface of major component container 11. Wiper 57 on major component piston 17 provides an inner seal about the outermost surface of minor component container 13.

In a particularly preferred embodiment, the wall of minor component container 13 is comprised of annealed aluminum about 0.002 inches (2 mils) thick. Because a wiper cross-section of the type employed on outermost wiper 55, which is commonly used in finger actuated paste pumps, would make assembly of major piston 17 about the very thin walls of minor components container 13 very difficult, a tapered lead-in 58 is provided on innermost wiper 57 to facilitate assembly of major component piston 17 onto the open end of minor component container 13.

Vent holes 59 can also be provided in major piston 17 to permit trapped air to escape when the major piston 17 is inserted during assembly. The flange 66 of knife support 60 can be used to block the vent holes 59 when the knife support 60 is subsequently inserted.

Minor component piston 18 is attached to plug 61 of knife support 60. Minor component piston 18 fits within minor component container 13 with wiper 62 providing an outermost seal with the innermost surface of minor component container 13. Minor component piston 18 preferably includes a downwardly sloping taper leading to wiper 62. The downwardly sloping taper facilitates insertion of minor component piston 18 within the thin wall of minor component container 13 without causing interference therebetween. Wiper 63 on minor component piston 18 provides an innermost seal with the outermost surface of rod 22.

Knife support 60 comprises an inner ring 64, an outer ring 65, spokes 54, knife edges 51, plug 61, and flange 66. Major component spring clip 52 attaches to the lower end of outer ring 65 and minor component spiring clip 53 attaches to the lower end of inner ring 64. Inner ring 64 is joined to outer ring 65 by means of spokes 54. Knife edges 51 are either formed on or attached to the uppermost edges of each of the spokes 54. Vent notch 69 in rod 22 can be used to permit air trapped within minor component container 13 to escape between the rod 22 and the wiper 63 of minor piston 18 when the minor piston 18, along with rod 22, is inserted into minor component container 13 during assembly. To facilitate such venting during assembly wiper 63 is positioned within the length of vent notch 69 as minor component piston 18 is initially inserted into minor component container 13.

Figures 6, 6A:
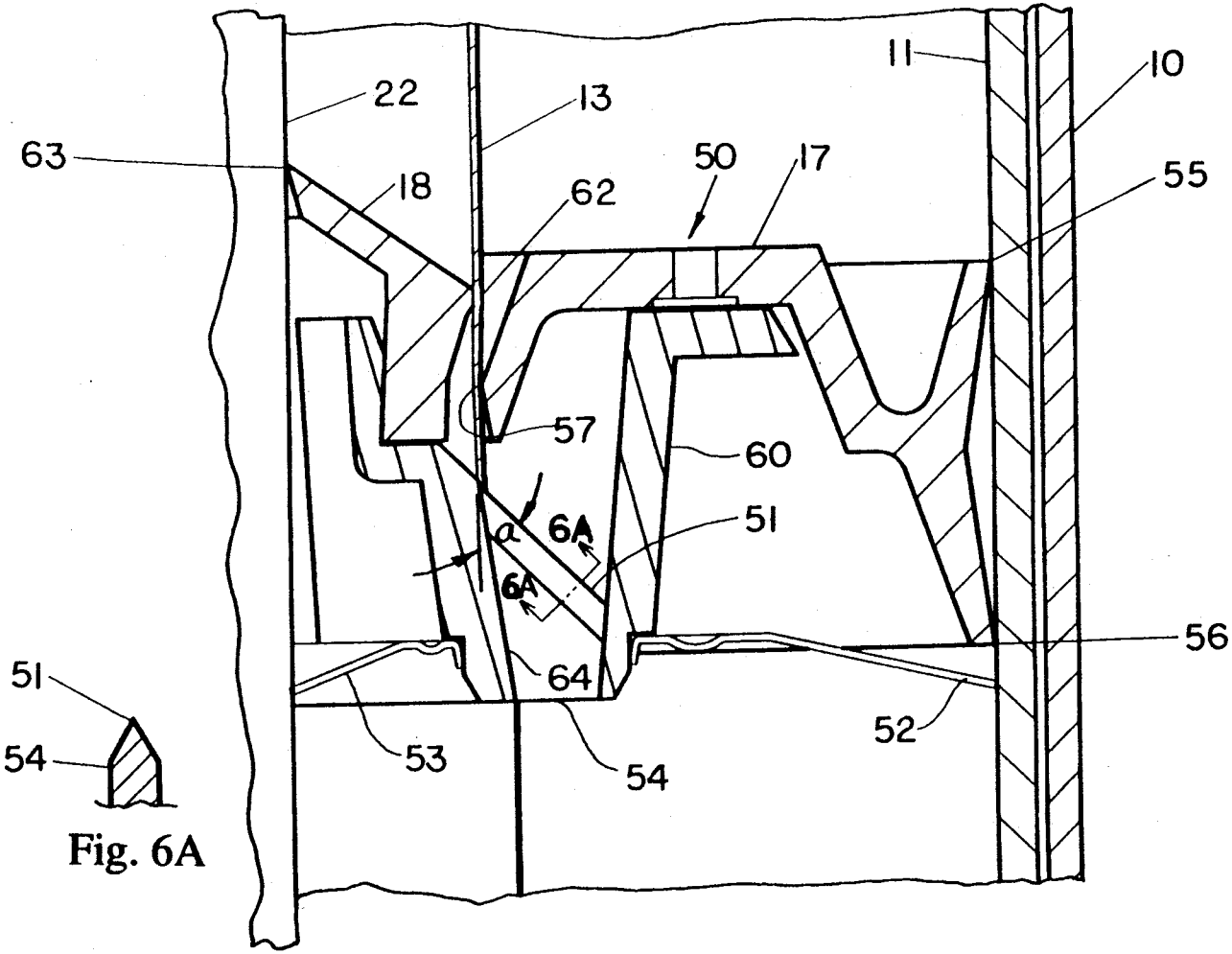
FIG. 6 is a greatly enlarged, partially sectioned, simplified view of a portion of the piston assembly of the dispenser of FIG. 5.
FIG. 6A is a simplified cross-sectional view of the knife edge portion of a radially oriented spoke of the piston coupling means in the dispenser of FIG. 6, said view being taken along section line 6A—6A of FIG. 6.

FIG. 6 is a greatly enlarged, partially sectioned, simplified view of a portion of the dispenser 1 in the vicinity of piston and knife assembly 50. The outside diameter of the wiper 62 on minor component piston 18 is slightly larger than the inside diameter of minor component container 13. The resulting slight interference forms a seal sufficient to substantially prevent the passage of the minor product component by causing a slight distortion of either the thin wall of the minor component container 13 or of the wiper 62 on minor component piston 18 or both.

The inside diameter of wiper 57 on major component piston 17 is slightly smaller than the outside diameter of minor component container 13. The resulting slight interference forms a seal sufficient to substantially prevent the passage of the major product component by causing a slight distortion of either the thin wall of minor component container 13 or of the wiper 57 on major component piston 17 or both.

Wiper 62 on minor component piston 18 in the assembled piston and knife assembly 50 preceded wiper 57 on major component piston 17. In a particularly preferred embodiment, the vertical distance between wiper 62 and wiper 57 is between about 0.04 inches and about 0.10 inches. The slight interference of wipers 62 and 57 inside and outside, respectively, of minor component container 13 and the vertical displacement between wiper 62 and wiper 57 causes a slight zig-zag configuration in the side wall of minor container 13. This zig-zag configuration is effective in maintaining sufficient pressure of the side wall of minor component container 13 against the wipers 62 and 57 so as to provide exceptionally good wiping of the product components from both inner and outer surfaces of the minor component container 13 as the piston and knife assembly 50 is upwardly advanced during use. The vertical displacement of wipers 62 and 57 with respect to one another exploits the resiliency of the thin side wall of minor component container 13 and serves to accommodate normal manufacturing variations in the diameters of wipers 62 and 57. This technique also enables the use of harder polymers for the inner minor component piston 18, e.g., the piston 18 may be comprised of the same polymer used to mold the knife support 60. If desired, the inner minor component piston 18 may be integrally molded with the knife support 60.

Minor spring clip 53 engages rod 22 and prevents downward movement of piston and knife assembly 50 relative to rod 22 when major component container 11 and minor component container 13 move downwardly in response to push button 37 being depressed. When push button 37 is released, major spring clip 52 engages the interior of major component container 11 thereby driving piston and knife assembly 50 upward relative to rod 22 as spring 41 returns major component container 11 and minor component container 13 from the depressed condition shown in FIG. 2 to the at rest condition shown in FIG. 1.

Each of spokes 54 includes a relatively sharp knife edge 51, as can best be seen in the cross-section of FIG. 6A. Knife edges 51 slope downwardly from inner ring 64 on minor component piston 18 at angle "a", relative to the longitudinal axis or length of the product reservoirs, as generally shown in FIG. 6. The downward sloping knife edges 51 penetrate the inside of minor component container 13 and engage the innermost surface of the side wall of the minor component container 13. This forces the side wall of minor component container 13 to outwardly expand along the relatively sharp knife edges 51 until the sharp edges either cut or cause rupture of the side wall at their points of contact therewith, as the piston and knife assembly 50 advances upwardly during the dispensing operation. Because the knife edges 51 of the present invention engage the side wall of the minor component container 13 obliquely rather than at right angles, as taught by the prior art, the cutting action is distributed along a substantial portion of the knife edge. This reduces the impact on and consequently degradation of the functional portion of the knife edge, which in turn permits the use of thermoplastics such as polystyrene, acetal, or nylon for knife edges 51, rather than metal, as taught by a number of prior art references. This permits integral molding of the knife edges 51 of the present invention with inner ring 64 and, if desired, outer ring 65, thereby reducing both the cost and difficulty of assembly of packages of the present invention. Further, the natural lubricity of the particular polymer selected for knife edges 51 of the present invention assists the flow of the side wall of the minor component container 13 down the knife edge 51 as the piston and knife assembly 50 is upwardly advanced during dispensing.

During upward movement of the piston and knife assembly 50 relative to minor component container 13, the side wall material of minor component container 13 which engages the knife edges 51 is increasingly stressed in tension as the diameter which is defined by the downward sloping knife edges 51 increases. The knife edges 51 serve to concentrate the stress within the side wall at the point of contact with the knife edges, thereby engaging and either cutting or causing controlled rupture of the sidewall.

The outermost surface of inner ring 64 helps to maintain a generally circular cross-section in the minor component container 13 intermediate the adjacent knife edges 51.

In a particularly preferred embodiment of the present invention, knife support 60 comprises three spokes 54 spaced approximately 120 degrees apart and angle "a" is about 45 degrees. However, the angle "a" of the knife edges 51 of the present invention can be varied from about 15 degrees to about 75 degrees with respect to the longitudinal axis of the concentric component containers 11 and 13. The slope of knife edges 51, i.e., angle "a", is preferably optimized for any given package of the present invention by taking into consideration factors such as the toughness and stiffness of the material of minor component container 13, the hardness of knife edge 51, its material of construction and its sharpness. In a particularly preferred embodiment of the present invention, minor component container 13 is comprised of annealed aluminum coated on both sides with varnish to prevent corrosion. Aluminum also provides exceptional barrier properties which can prevent undesirable transmission of one product component into the other prior to dispensing.

The side wall of minor component container 13 may also be comprised of a multi-layer laminate structure. For example, a layer of aluminum foil and paper, for barrier and stiffness respectively, sandwiched between opposed layers of polyethylene for moisture resistance. Laminate structures of the aforementioned type are commonly used to produce toothpaste tubes.

In FIG. 6, the already slit side wall material of minor component container 13 shown passing beneath spoke 54 is indicated as 13'. As the piston and knife assembly 50 is advanced upwardly along rod 22 during dispensing, the sidewall of minor component container 13 is separated into three discrete, substantially equal sections, each trailing behind the spokes 54 in the piston and knife assembly 50.

Figure 2:
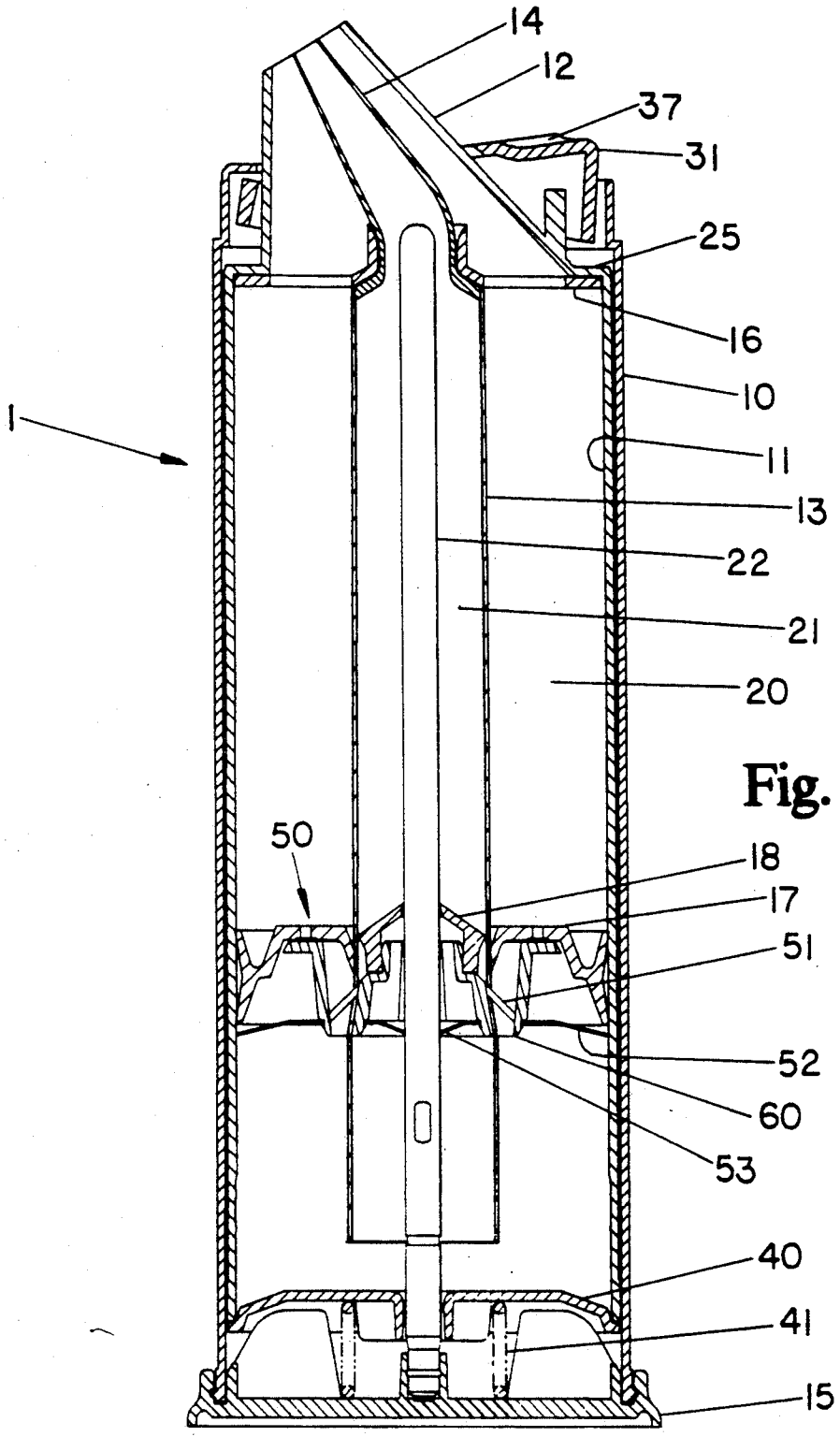
FIG. 2 is another cross-sectional view f the dispenser of FIG. 1 with the over cap removed and the push button in the depressed condition.

To dispense concentric streams of major and minor product components from dispenser 1, the user depresses push button 37 shown in FIG. 3. When push button 37 is depressed, actuator 31 rotates about fixed pivot 32 causing cam 33 to operate against upper wall 25 of major component container 11. In a particularly preferred embodiment, fixed pivot 32, cam 33, and push button 37 are positioned relative to one another so as to provide a mechanical advantage for the push button in the range of about 3:1. The rotation of actuator 31 when push button 37 is depressed forces major component container 11 downward relative to shell 10. FIG. 2 illustrates push button 37 depressed with major component container 11 shifted downward with respect to shell 10. Major component nozzle 12, support 16, minor component container 13, minor component nozzle 14, and washer 40 are all attached to or engage major component container 11. Forcing major component container 11 downward relative to shell 10 causes an equivalent displacement in the attache members. Consequently, spring 41 is further compressed between washer 40 and base 15.

Rod 22 is attached to base 15 which is also attached to shell 10. Therefore rod 22 remains substantially stationary relative to shell 10 during dispensing. Minor spring clip 53 engages rod 22 and serves to maintain the vertical position of piston and knife assembly 50 relative to rod 22 as major and minor component containers 11 and 13, respectively, and the substantially incompressible major and minor product components (not shown) contained within major and minor component reservoirs 20 and 21, respectively, are forced downwardly against the substantially stationary piston and knife assembly 50. This results in a reduction in volume of major and minor component reservoirs 20 and 21, respectively. Accordingly, the substantially incompressible major product component (not shown) in major component reservoir 20 is forced through major flow path 24, defined by openings 19 in support 16 and the concentric annular channel formed between the interior surface of major component nozzle 12 and the exterior surface of minor component nozzle 14.

The substantially incompressible minor product component in minor component reservoir 21 is forced through minor flow path 25 in a generally similar manner. In the preferred embodiment disclosed in FIG. 1, the major product component is dispensed generally coaxially about the minor product component from the outlets of major component nozzle 12 and minor component nozzle 14, respectively.

As the minor component container 13 is forced downwardly relative to the substantially stationary piston nd knife assembly 50 during dispensing, those portions of the side wall of minor component container 13 which contact knife edges 51 are forced to expand outwardly against knife edges 15 under greater and greater circumferential tension until they are either slit by the knife edges 51 or are caused to rupture at their points of contact therewith. This, of course, permits the slit or ruptured material of minor component container 13 to pass to either side of each spoke 54 during the dispensing operation. It is this arrangement of spokes 54 which permits the knife support 60 to link the major component piston 17 and minor component piston 18 to one another without any appreciable increase in overall package height.

When the force applied on push button 37 is released, energy stored in spring 41 forces major component container 11 back to its normal at rest position relative to shell 10, as generally shown in FIG. 1. Because major spring clip 52 engages the interior of major component container 11, return of major component container 11 to its at rest position carries piston and knife assembly 50 upward with respect to rod 22, which remains substantially stationary. Upward movement of the piston and knife assembly 50 also upwardly advances minor spring clip 53 on rod 22 to a next incremental position at which point the package is ready for a subsequent product dispensing operation. Piston and knife assembly 50 incrementally advances toward the upper reaches of the dispenser with each depression and release of push button 37 in the foregoing manner until major component piston 17 and minor component piston 18 substantially about support 16 and/or the lowermost end of minor component nozzle 14. At this point interference between the abutting components prevents further dispensing.

In a particularly preferred embodiment of the present invention, the general contour of the upper surfaces of the major component piston 17 and the minor component piston 18 conform to the general contour of lowermost surfaces of the elements to which they will ultimately abut at the end of the dispensing cycle. This arrangement minimizes the presence of residual product within the package when further upward movement of the piston and knife assembly 50 is prevented by interference with the abutting package components. It also helps to ensure substantially simultaneous runout of both major and minor product components.

It is believed that the packages described herein and their attendant advantages will be understood from the foregoing description. It will, of course, be apparent to those skilled in the art that various changes may be made in form, construction, and arrangement without departing from the spirit and scope of the invention, and it is intended to cover in the appended claims all such modifications that are within the scope of this invention.

What is claimed is:

1. A dispensing package for containing and simultaneously dispensing a plurality of fluent materials which remain substantially separated from one another until they are dispensed from said package, said dispensing package comprising:

(A) a first reservoir for storing a first fluent material, said first reservoir comprising a first elongated tubular wall portion having a first outlet means located at one end thereof and a first piston located at the other end thereof, said first piston being in contact with said first fluent material;

(b) a second reservoir for storing a second fluent material concentrically about said first reservoir, said second reservoir being formed by said first elongated tubular wall portion and a second elongated tubular wall portion which is concentric about an coextensive with said first elongated tubular wall portion along at least a portion of its length, said second reservoir including a second outlet means located at the end of said second reservoir which is nearest said first outlet means in said first reservoir, said second reservoir further including a second piston at the other end of said second reservoir, said second piston being in contact with said second fluent material;

(c) coupling means mounted behind said first and second pistons for securing said pistons to one another in a manner that will cause them to simultaneously advance toward their respective outlet means and simultaneously dispense said first and second fluent materials at a substantially constant predetermined ratio, said coupling means comprising a plurality of radially oriented spokes, the forwardmost portion of each of said spokes including a knife edge, said knife edge being oriented at an acute angle relative to the longitudinal axis of said first and second reservoirs, whereby said knife edges engage, outwardly expand and rupture said elongated tubular wall portion of said first reservoir as said piston coupling means and said pistons are advanced toward said first and second outlet means; and (d) actuating means for unidirectionally advancing said piston coupling means and said pistons toward said first and second outlet means in response to external forces applied to said package by the user.

2. The dispensing package of claim 1, wherein said first outlet means is generally concentric within said second outlet means.

3. The dispensing package of claim 2, wherein said first outlet means and said second outlet means are located in a common plane.

4. The dispensing package of claim 1, wherein said first elongated tubular wall portion of said first reservoir is comprised of a deformable material.

5. The dispensing package of claim 4, wherein said first deformable material comprises aluminum foil.

6. The dispensing package of claim 5, wherein said aluminum foil exhibits a thickness in the range of about 0.002 inches to about 0.010 inches.

7. The dispensing package of claim 4, wherein said first elongated tubular wall portion of said first reservoir comprises a laminated structure comprising at least one inner layer of aluminum foil, said inner layer having at least one polymeric layer on each of its opposed surfaces.

8. The dispensing package of claim 1, wherein said knife edges on said spokes are comprised of molded thermoplastic material.

9. The dispensing package of claim 1, wherein the acute angle formed between said knife edges and the longitudinal axis of said first and second reservoirs is between about 15 degrees and about 75 degrees.

10. The dispensing package of claim 9, wherein said acute angle is about 45 degrees.

11. The dispensing package of claim 1, wherein said first piston includes a downwardly sloping generally conical surface leading to its outermost perimeter which wipes against the interior surface of said first elongated tubular wall to facilitate easy insertion of said first piston into said first reservoir.

12. The dispensing package of claim 1, wherein said second piston includes a downwardly sloping generally conical surface leading to its innermost perimeter which wipes against the exterior surface of said first elongated tubular wall to facilitate easy insertion of said second piston into said second reservoir about said first reservoir.

13. The dispensing package of claim 1, wherein said actuating means for unidirectionally advancing said piston comprises a push button operated lever rotatably secured to a pivot to provide suitable mechanical advantage to displace said first and second reservoirs downward relative to said first and said second pistons which are secured to one another by said coupling means, said coupling means further including a spring clip which engages a rod having a substantially fixed mechanical relationship with respect to said pivot of said push button operated lever, said spring clip preventing said pistons from moving downwardly with said first and second reservoirs, but permitting said pistons to move upwardly along with said first and second reservoirs when said reservoirs return to their at rest position.

14. The dispensing package of claim 13, wherein the mechanical advantage exhibited by said push button operated lever is about 3:1.

15. A dispensing package for containing and simultaneously dispensing a plurality of fluent materials which remain substantially separated from one another until they are dispensed from said package, said dispensing package comprising:

(a) a first reservoir for storing a first fluent material, said first reservoir comprising a first elongated tubular wall portion having a first outlet means located at one end thereof and a first piston located at the other end thereof, said first piston being in contact with said first fluent material;

(b) a second reservoir for storing a second fluent material concentrically about said first reservoir, said second reservoir being formed by said first elongated tubular wall portion and a second elongated tubular wall portion which is concentric about and coextensive with said first elongated tubular wall portion along at least a portion of its length, said second reservoir including a second outlet means located at the end of said second reservoir which is nearest said first outlet means in said first reservoir, said second reservoir further including a second piston at the other end of said second reservoir, said second piston being in contact with said second fluent material;

(c) coupling means mounted behind said first and second pistons for securing said pistons to one another in a manner that will cause them to simultaneously advance toward their respective outlet means and simultaneously dispense said first and second fluent materials at a substantially constant predetermined ratio, said coupling means comprising an innermost piston support member for engaging said first piston and an outermost piston support member for engaging said second piston, said innermost piston support member and said outermost piston support member being joined to one another by a plurality of radially oriented spokes, the forwardmost portion of each of said spokes including a knife edge, said knife edge being oriented at an acute angle relative to the longitudinal axis of said first and second reservoirs, whereby said knife edges engage, outwardly expand and rupture said elongated tubular wall portion of said first reservoir as said piston coupling means and said pistons are advanced toward said first and second outlet means; and (d) actuating means for unidirectionally advancing said piston coupling means and said pistons toward said first and second outlet means in response to external forces applied to said package by the user.

16. The dispensing package of claim 15, wherein said knife edges on said spokes, said spokes and said first and second piston support members are comprised of thermoplastic material.

17. The dispensing package of claim 16, wherein said knife edges on said spokes, said spokes and said first and second piston support members are integrally molded.

* * * * *

UNITED STATES PATENT AND TRADEMARK OFFICE

CERTIFICATE OF CORRECTION

PATENT NO. : 5,209,376

DATED : May 11, 1993

INVENTOR(S) : Robert S. Dirksing

It is certified that error appears in the above-identified patent and that said Letters Patent is hereby corrected as shown below:

On the title page, item (56):

In the REFERENCES CITED section, second column, "4,560,610" should read -- 4,566,610 -- .

In the REFERENCES CITED section, second column, "4,588,920" should read -- 4,538,920 -- .

Column 3, line 27, "f" should read -- of -- .

Column 3, line 56, "attache" should read -- attached -- .

Column 3, line 57, "14" should read -- 15 -- .

Column 4, line 61, "components" should read -- component -- .

Column 5, line 18, "spiring" should read -- spring -- .

Column 5, line 52, "preceded" should read -- precedes -- .

Column 7, line 57, "attache" should read -- attached -- .

Column 8, line 22, "nd" should read -- and -- .

Column 8, line 53, "about" should read -- abut -- .

UNITED STATES PATENT AND TRADEMARK OFFICE

CERTIFICATE OF CORRECTION

PATENT NO. : 5,209,376

DATED : May 11, 1993

INVENTOR(S) : Robert S. Dirksing

It is certified that error appears in the above-indentified patent and that said Letters Patent is hereby corrected as shown below:

Column 9, line 26, "an" should read --and--.

Signed and Sealed this

First Day of February, 1994

Bruce Lehman

*Attest:*

BRUCE LEHMAN

*Attesting Officer*

*Commissioner of Patents and Trademarks*